US009227335B2

(12) United States Patent
Duncan

(10) Patent No.: US 9,227,335 B2
(45) Date of Patent: Jan. 5, 2016

(54) SYSTEM AND METHOD FOR CUTTING TUBULAR SHRINK SLEEVE MATERIAL FOR APPLICATION TO CONTAINERS

(71) Applicant: Adam W. Duncan, Durham, NC (US)

(72) Inventor: Adam W. Duncan, Durham, NC (US)

(73) Assignee: Axon LLC, Raleigh, NC (US)

( * ) Notice: Subject to any disclaimer, the term of this patent is extended or adjusted under 35 U.S.C. 154(b) by 210 days.

(21) Appl. No.: 14/095,630

(22) Filed: Dec. 3, 2013

(65) Prior Publication Data

US 2015/0151446 A1 Jun. 4, 2015

(51) Int. Cl.

| | |
|---|---|
| ***B26D 5/08*** | (2006.01) |
| ***B26D 1/26*** | (2006.01) |
| ***B26D 3/16*** | (2006.01) |

(52) U.S. Cl.

CPC *B26D 5/08* (2013.01); *B26D 1/265* (2013.01); *B26D 3/164* (2013.01); *B26D 3/167* (2013.01); *Y10T 83/0524* (2015.04); *Y10T 83/7487* (2015.04); *Y10T 83/8769* (2015.04); *Y10T 83/8789* (2015.04)

(58) Field of Classification Search

CPC ..... B26D 5/08; B26D 3/167; B26D 1/265; B26D 3/16; Y10T 83/7487; Y10T 83/8769; Y10T 83/0524; Y10T 82/16672; Y10T 83/8812; Y10T 83/929; Y10T 83/04; Y10T 82/16688; Y10T 82/10; Y10T 83/0311; Y10T 83/8877; Y10S 83/924; Y10S 83/946

USPC ..... 83/39, 597, 607, 663, 647.5, 651, 924, 83/946, 92, 364, 639.1, 54, 598, 370, 83/356.3, 410.9, 411.1, 411, 84; 30/92, 30/97, 101, 102, 70, 72.2; 82/101, 46, 83, 82/93, 92, 701, 70.2, 54, 113, 84, 85, 82/1.11; 56/269, 389.2, 64, 65, 68, 551, 56/552, 557, 563; 156/556, 86, 353, 443, 156/521, 215

See application file for complete search history.

(56) References Cited

U.S. PATENT DOCUMENTS

| | | | | | |
|---|---|---|---|---|---|
| 3,151,494 | A * | 10/1964 | Sedgwick | F16H 57/12 474/133 |
| 3,722,339 | A * | 3/1973 | Boyer | A23N 15/08 83/404.4 |
| 5,531,858 | A | 7/1996 | Hong | |
| 5,791,220 | A | 8/1998 | Liao | |
| 5,916,342 | A | 6/1999 | Ingram | |
| 5,970,685 | A | 10/1999 | Huang | |
| 6,502,488 | B1 | 1/2003 | Taylor | |

(Continued)

*Primary Examiner* — Ghassem Alie

(74) *Attorney, Agent, or Firm* — Thompson Hine LLP

(57) ABSTRACT

A tubular film cutting arrangement for cutting tubular shrink film into sleeves of suitable length for application to containers includes a support member having a film passage opening therein; a plurality of knife drive pulleys rotatably mounted to the support member and spaced apart around the film passage opening, each knife drive pulley having a knife member mounted thereon for rotation with the knife drive pulley; a plurality of idler rollers rotatably mounted to the support member, each idler roller arranged between two of the knife drive pulleys, wherein a drive belt path is formed between the knife drive pulleys and the idler rollers; and a drive belt extending along the drive belt path such that a first side of the drive belt is in contact with each of the knife drive pulleys and a second side of the drive belt is in contact with each of the idler rollers; wherein the idler rollers are positioned to interact with the second side of the drive belt in order to hold the first side of the drive belt in contact with the knife drive pulleys.

6 Claims, 4 Drawing Sheets

(56) References Cited

U.S. PATENT DOCUMENTS 6,829,971 B1 12/2004 Huang et al.
7,231,748 B2 * 6/2007 Liao ..... B65C 3/065 493/478
7,562,611 B2 7/2009 Chen
7,987,750 B2 8/2011 Huang
2003/0084772 A1 * 5/2003 Shen ..... B23D 21/04 83/597
2003/0121156 A1 * 7/2003 Walsh ..... B26D 3/169 30/97

* cited by examiner

SYSTEM AND METHOD FOR CUTTING TUBULAR SHRINK SLEEVE MATERIAL FOR APPLICATION TO CONTAINERS

TECHNICAL FIELD

The present application relates generally to machines that apply tubular shrink sleeve material to containers and, more particularly, to a system and method for cutting tubular shrink sleeve material while on a tooling mandrel.

BACKGROUND

Tubular shrink sleeve application devices commonly utilize a mandrel over which a tubular shrink film is moved for cutting, and then the cut sleeve-type label is ejected from the mandrel onto a container located below the mandrel.

A variety of film cutter mechanisms are known. U.S. Pat. No. 5,531,8858 discloses a film cutter in which dual belts are used to rotate multiple knife drive pulleys 41, each having a knife 411 mounted thereon. U.S. Pat. No. 5,791,220 discloses a film cutter in which more than two belts are used to rotate multiple knife drive pulleys, each having a knife connected thereto via an axle, where the belts are arranged in series with a primary bely extending from a prime mover assembly to one knife drive pulley assembly and with each subsequent belt extending from one knife drive pulley assembly to the next.

However, it would be desirable and advantageous to provide a system and method that is simpler and/or more readily adapted to permit cutting of all tubular films, including tubular film when in either an expanded round or an expanded non-round cross-sectional shape.

SUMMARY

In one aspect, a tubular film cutting arrangement for cutting tubular shrink film into sleeves of suitable length for application to containers includes a support member having a film passage opening therein; a plurality of knife drive pulleys rotatably mounted to the support member and spaced apart around the film passage opening, each knife drive pulley having a knife member mounted thereon for rotation with the knife drive pulley; a plurality of idler rollers rotatably mounted to the support member, each idler roller arranged between two of the knife drive pulleys, wherein a drive belt path is formed between the knife drive pulleys and the idler rollers; and a drive belt extending along the drive belt path such that a first side of the drive belt is in contact with each of the knife drive pulleys and a second side of the drive belt is in contact with each of the idler rollers; wherein the idler rollers are positioned to interact with the second side of the drive belt in order to hold the first side of the drive belt in contact with the knife drive pulleys.

In one implementation of the arrangement a mandrel passes through the film passage opening and about which tubular film can be passed for cutting, wherein the mandrel has a shape that is non-round at least in vicinity of the support member to hold the tubular film in a non-round configuration during cutting; wherein a shape of the film passage opening is non-round and substantially corresponds to the shape of the mandrel in vicinity of the support member.

In one implementation of the arrangement, a shape of the film passage opening is non-round.

In one implementation of the arrangement, the drive belt path includes an entry side and an exit side located proximate each other, the entry side defined between a first of said knife drive pulleys and an entry idler roller, the exit side defined between a second of said knife drive pulleys and an exit idler roller.

In one implementation of the arrangement, a driving system is coupled for effecting moving of the drive belt so as to cause the knife members to move into and out of a film path through the film passage opening.

In one implementation of the arrangement, each knife member has opposed cutting edges to enable cutting of film regardless of direction of rotation of the knife member, and the driving system is configured to alternatingly and repeatedly move the drive belt in a first direction for one film cutting operation and a second, opposite direction for a next cutting film cutting operation.

In one implementation of the arrangement, each knife drive pulley is a toothed member and the first side of the drive belt includes teeth.

In another aspect, a tubular film cutting arrangement for cutting tubular shrink film into sleeves of suitable length for application to containers includes: a film path along which film travels; a plurality of rotatable knife drive pulleys spaced apart around the film path, each knife drive pulley having a knife member mounted for rotation with the knife drive pulley; a plurality of idlers rotatably arranged to define a drive belt path between the knife drive pulleys and the idlers; a drive system for the knife drive pulleys, including: a primary mover assembly spaced away from the knife drive pulleys and the idlers; and a single drive belt that both (i) engages with the primary mover assembly so as to be moved by the primary mover and (ii) extends to and along the drive belt path such that a first side of the drive belt is in contact with each of the knife drive pulleys and a second side of the drive belt is in contact with each of the idler rollers, and the plurality of idlers are positioned to interact with the second side of the drive belt in order to hold the first side of the drive belt in contact with the knife drive pulleys.

In one implementation of the cutting arrangement, both the knife drive pulleys and the idlers are mounted on a plate having an opening through which the film path travels; and the primary mover assembly is spaced apart from the support member and the single drive belt extends from the drive belt path and beyond a perimeter of the support member to the primary mover.

In one implementation of the arrangement, the drive belt path includes an entry side and an exit side located proximate each other, the entry side defined between a first of said knife drive pulleys and an entry idler, the exit side defined between a second of said knife drive pulleys and an exit idler, the single drive belt first extends from the prime mover to the entry idler before contacting any knife drive pulley, and extends from the exit idler to the prime mover assembly without any intermediate contact with any knife drive pulley.

In one implementation of the arrangement, a tooling mandrel is located within the film path such that film is passed around the tooling mandrel as it moves past the knife drive pulleys, wherein the tooling mandrel has a shape that is non-round at least in vicinity of the knife drive pulleys to hold film in a non-round configuration during cutting.

In one implementation of the arrangement, each knife member has opposed cutting edges to enable cutting of film regardless of direction of rotation of the knife member, and a control is provided for the prime mover, wherein the control is configured to alternatingly and repeatedly control the prime mover to move the drive belt in a first direction for one film cutting operation and a second, opposite direction for a next cutting film cutting operation.

In another aspect, a method of cutting tubular film involves: (a) providing a plurality of rotatable knife members in positions disposed about a tubular film travel path, each knife member having first and second opposed cutting edges; (b) moving each knife member in a first direction through the tubular film travel path to cut one length of film using the first cutting edge of each knife member; and (c) moving each knife member in a second direction, opposite the first direction, to cut another length of film using the second cutting edge of each knife member.

In one implementation of the method, step (b) is repeated multiple times before carrying out step (c), and step (c) is then repeated multiple times.

In another implementation of the method, steps (b) and (c) are repeatedly and sequentially carried out for multiple cutting operations such that the knife members are moved back and forth between the first direction and the second direction.

DETAILED DESCRIPTION

Figure 1:
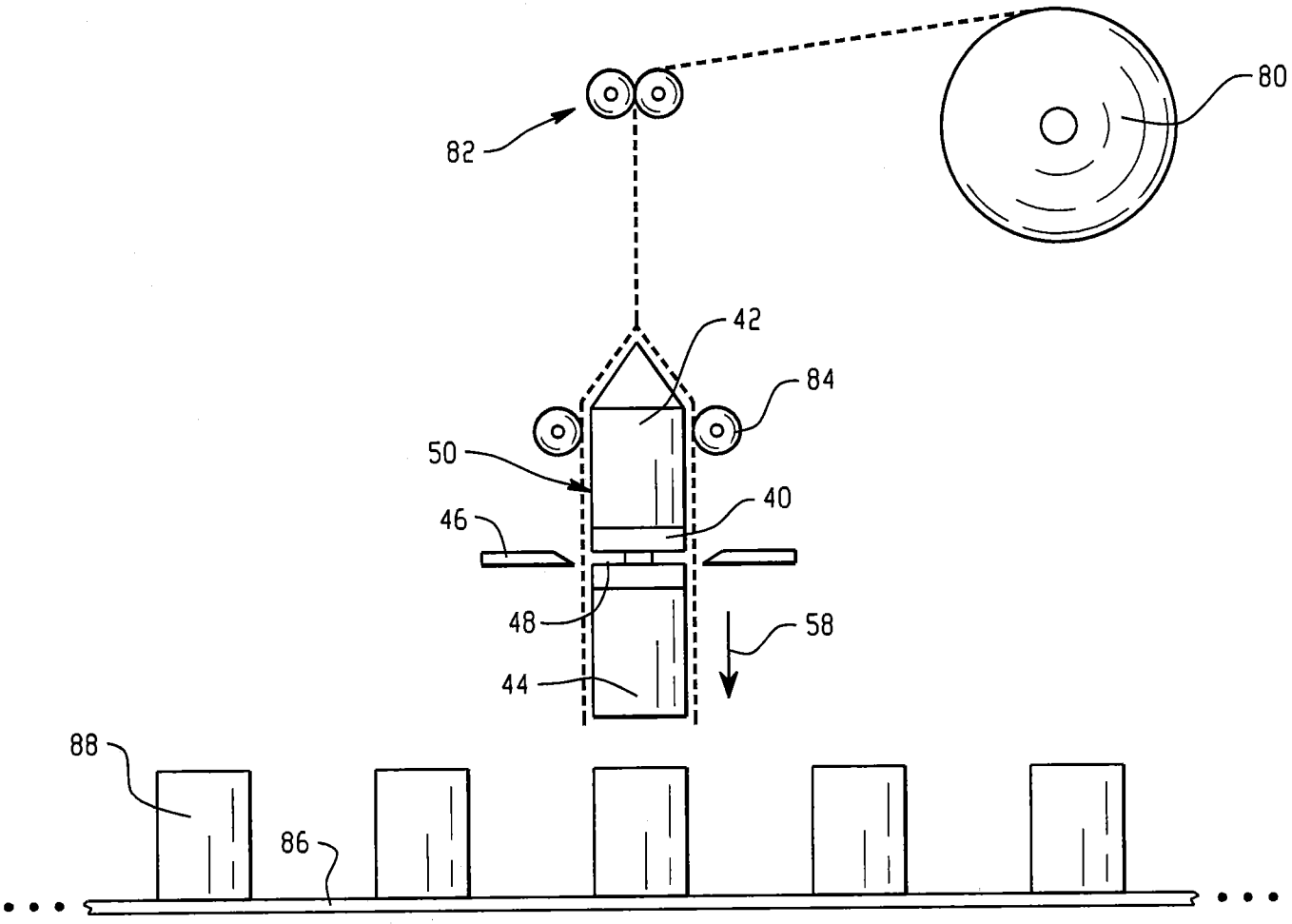
FIG. 1 shows a schematic view of one embodiment of a shrink sleeve applying apparatus.

An exemplary tubular shrink sleeve applying apparatus is shown in schematic form in FIG. 1 and includes a roll 80 or other supply of tubular film that delivers the film to a pair of tubular film drivers 82 located above the tooling mandrel 50 for moving the film down toward the mandrel. The top of the tooling mandrel is shaped to cause the tubular film to spread from its flat orientation to an expanded orientation as it moves down around the mandrel 50. A set of film drive rollers 84 control feeding of the film downward along the mandrel (e.g., per arrow 58) toward a cutting mechanism 46 that is aligned with a cutting slot 48 in the external surface of the tooling mandrel. Sleeve drivers 84 operate in coordination with drivers 82 and interact with rollers in the sleeve drive slots to move the tubular film downward along the mandrel assembly. A container conveyance mechanism 86 passes beneath the mandrel and carries containers 88 in a conveyance direction 90 such that cut sleeves are moved off the mandrel assembly and onto the containers passing thereby. A downstream application of heat can then be used to shrink the film. Other variations of the apparatus are possible, including embodiments that do not include the film drivers 82.

In one embodiment, the tooling mandrel may be of a multi-component type including an upper part 42, lower part 44 and a cutting insert 40 as described in U.S. Patent Publication No. 2012/0011811, commonly assigned to the assignee of the present application, and which is incorporated herein by reference. However, other tooling mandrel types and configurations are contemplated for use in connection with the innovative cutting arrangement of the present application, which is described in detail below.

Figure 2:
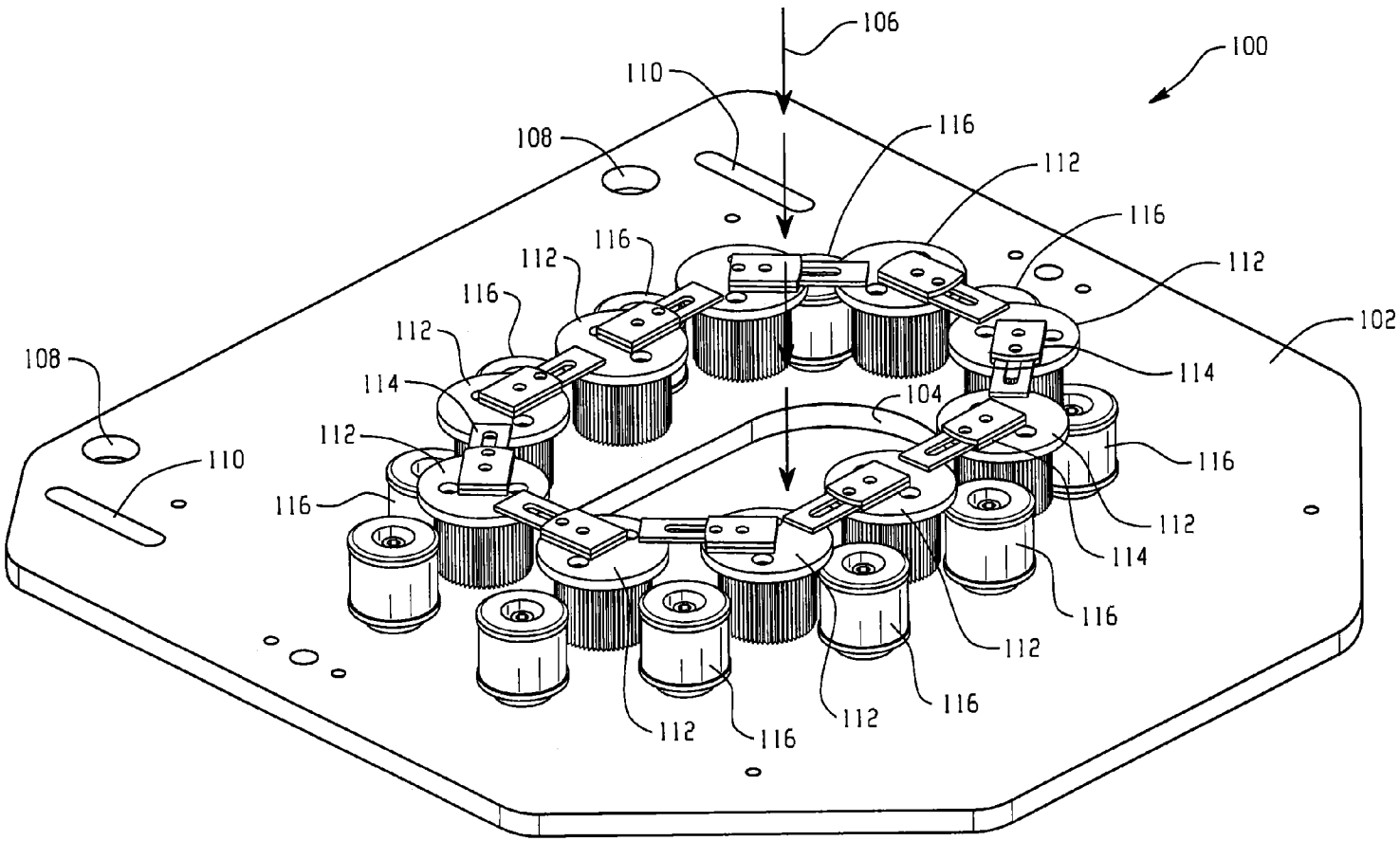
FIG. 2 shows one embodiment of a film cutting assembly.

Referring now to FIG. 2, an exemplary embodiment of the innovative tubular film cutting arrangement 100 is shown in part. A support member 102 includes a film passage opening 104 therein. Thus a film travel path extends through the opening 104 as indicated by arrows 106. In one implementation the support member 102 may be of metal plate construction, but other implementations are possible. The tooling mandrel (not shown in FIG. 2) also passes through opening 104. The support member 102 includes other openings (e.g., holes 108 and slots 110) to facilitate mounting and position of the cutting mechanism in a shrink sleeve applying apparatus.

As shown, a plurality of knife drive pulleys 112 are each rotatably mounted to the support member and are spaced apart around the film passage opening 104. Each knife drive pulley includes a corresponding knife member 114 mounted for rotation with the knife drive pulley. In the illustrated embodiment each knife member 114 is mounted directly to the top of the its respective knife drive pulley, but variations are possible, such as some intermediate structure extending between the knife drive pulley and the knife member. Each knife drive pulley may be, per the illustrated embodiment, have an external surface with teeth, though other variations are possible. The knife members 114 are all located in substantially in the same plane (e.g., aligned with the cutting slot in the tooling mandrel) and positioned such that a swing path of each knife member will pass through a section of tubular film that extends downward through the opening 104, with the paths overlapping slightly to assure a complete cut of the film.

Figure 3:
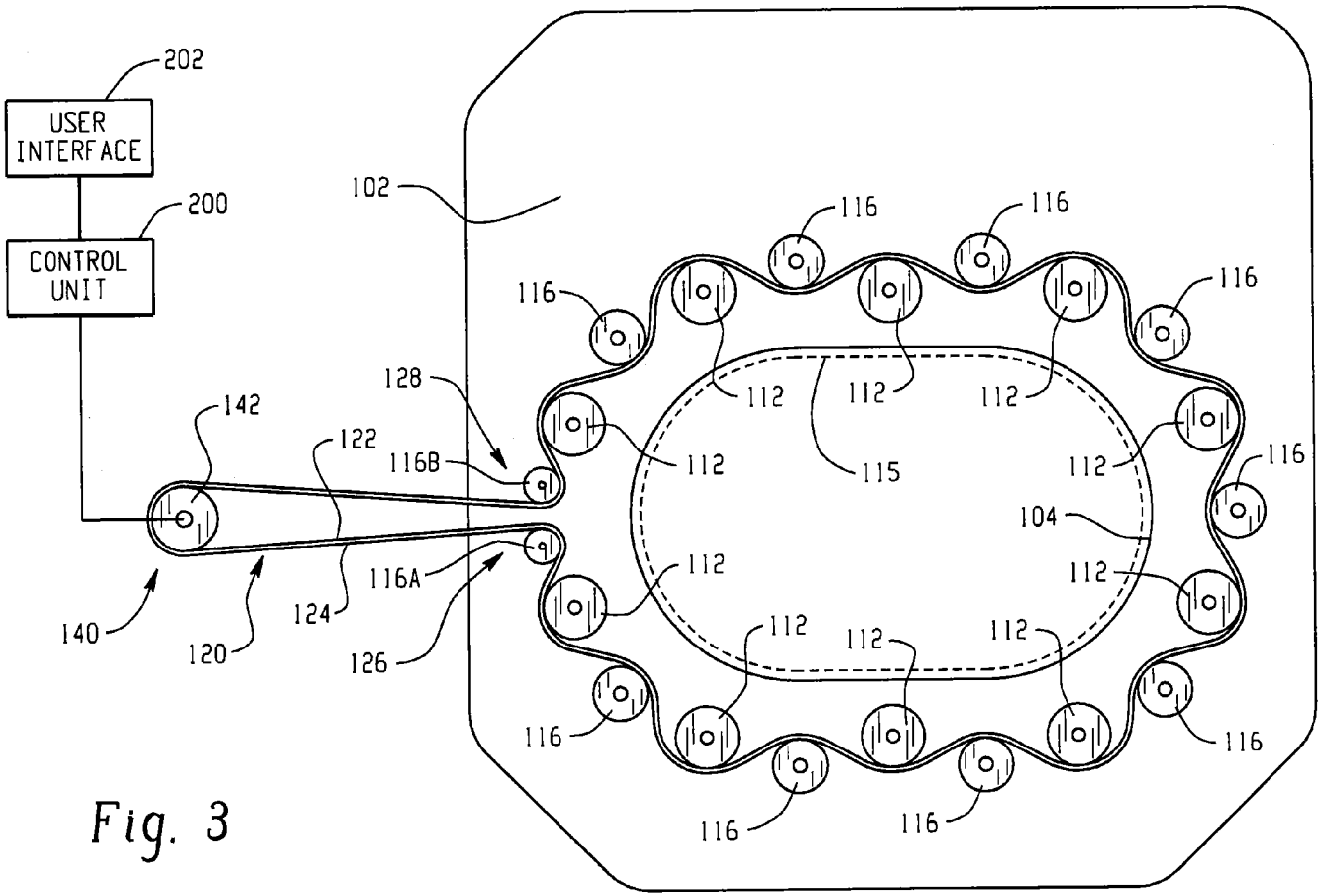
FIG. 3 shows a partial schematic top view of the film cutting assembly of FIG. 2 with drive belt and driving system.

A plurality of idler rollers 116 (e.g., non-toothed pulley structures) are also rotatably mounted to the support member 102. Each idler roller is arranged between two adjacent knife drive pulleys as shown to form a drive belt path between the knife drive pulleys and the idler rollers. Per FIG. 3, where the knife members are not shown for clarity, a drive belt 120 extends along the drive belt path such that one side 122 (e.g., the interior facing side in the illustrated embodiment) of the drive belt is in contact with each of the knife drive pulleys 112 and the opposite side 124 (e.g., the exterior facing side in the illustrated embodiment) of the drive belt is in contact with each of the idler rollers 116. The relative positioning of the idler rollers 116 and knife drive pulleys 112 is such that the drive belt path (and thus the belt traveling within the path) curves back and forth (e.g., in a snake-like manner or circuitous manner) as the drive belt path moves around the opening 104, as best seen in the top plan view of FIG. 3, where the film passing through opening 104 is shown by dashed line 115. Thus, the idler rollers 116 are positioned to interact with side 124 of the drive belt in order to hold side 122 of the drive belt in contact with the knife drive pulleys 112, regardless of the shape of the opening 104, which in the illustrated embodiment happens to be an elongated slot (i.e., non-round).

Notably, the drive belt path includes an entry side 126 and an exit side 128 located proximate each other. The entry side is defined between one of the knife drive pulleys 112 and an entry idler roller 116A, and the exit side is defined between another of the knife drive pulleys 112 and an exit idler roller 116B. This arrangement facilitates use of a single drive belt 120 running from a primary mover assembly 140 (e.g., made up of a motor linked to a primary toothed drive roller 142) and through the drive belt path between the knife drive pulleys 112 and the idler rollers. The entry side and the exit side is dependent upon the direction of movement of the belt, and thus in the dual direction embodiments described further below each idler roller 116A and 116B functions as both an exit idler roller and an entry idler roller. As shown, the prime mover assembly 140 may be positioned so as to be spaced away from the pulleys 112 and roller 116 (e.g., and external of the footprint of the support member 102).

Figure 4:
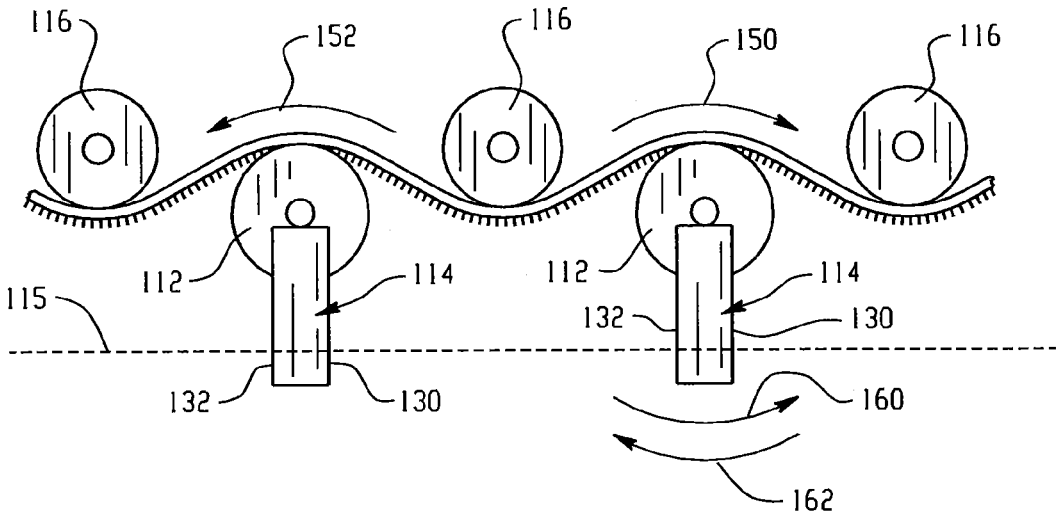
FIG. 4 shows a partial schematic top view of the cutting assembly of FIG. 2.

The primary mover assembly 140 is controlled by a control unit 200 that is coupled to control the energization of the primary mover motor for effecting moving of the drive belt 120 so as to cause the knife members 114 to move into and out of the film path to cut film. In one embodiment, each knife member 114 has opposed cutting edges 130 and 132 (FIG. 4) to enable cutting of film regardless of the direction of rotation of the knife member. This configuration enables prolonged use of the cutting mechanism in between necessary replacement of the knife members when worn.

In one arrangement, the driving system may rotate the knife members in the same direction repeatedly for cutting operations so that only one cutting edge of each knife member is being used for cutting operations. When a determination is made that the knife members are worn, the driving system may then change the direction of rotation of the knife members for future cutting operations. The change in direction may be made via a user interface 202, or may be automated (e.g., programmed to occur after a certain number of cutting operations or after a certain time period of machine operation). In another arrangement, the driving system is configured to alternatingly and repeatedly move the drive belt in one direction (e.g., per arrow 150) for one film cutting operation and an opposite direction (e.g., per arrow 152) for a next cutting film cutting operation. In this arrangement each cutting knife would be repeatedly and sequentially moved back and forth through the film path in arcuate paths 162 and 160 so that the knife edges 130 and 132 are alternatingly used for each cutting operation. In either of these arrangements, having a two-sided cutting knife effectively doubles the operating life of the cutter without having to replace the cutting blades.

Figure 5:
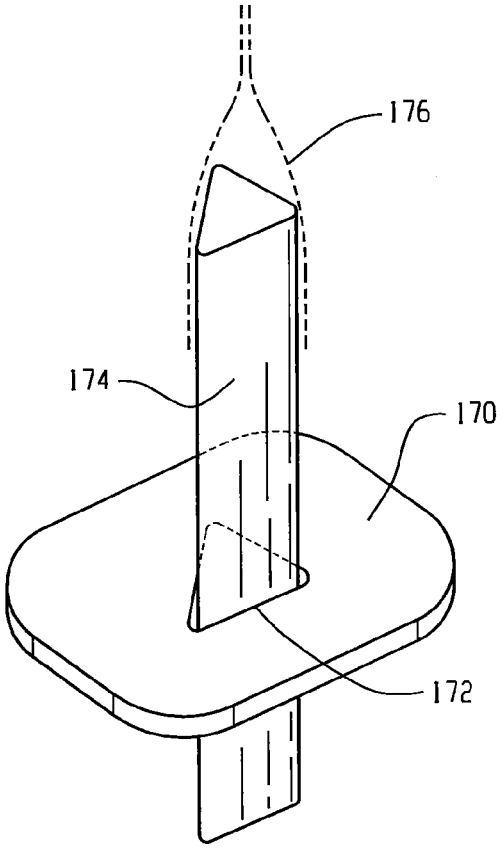
FIG. 5 shows a perspective schematic view of one embodiment of a non-round mandrel and corresponding support member.

As mentioned above, the subject cutting arrangement is particularly useful in facilitating the cutting of tubular film that is out of round. Referring to the schematic embodiment of FIG. 5, a support member 170 includes generally triangular (in top plan view) film passage opening 172 with a similarly shaped tooling mandrel 174 extending therethrough and about which the film 176 is expanded and held in the triangular cross-sectional shape (with cross-section taken perpendicular to the elongated axis of the tooling mandrel) during a cutting operation. The knifes and idlers are not included in FIG. 5 for the sake of clarity. It is recognized that other non-round shapes could be implemented (e.g., for more effective application of cut film to non-round containers). Of course, the described cutting arrangement could also be implemented with the typical round or right circular cylinder shaped tooling mandrel and film. All round and non-round expanded shapes of the film are variations of tubular film shapes that can be cut using the innovative cutting arrangement and method.

Although the invention has been described and illustrated in detail, it is to be clearly understood that the same is intended by way of illustration and example only, and is not intended to be taken by way of limitation. Thus, it is recognized that numerous other variations exist, including both narrowing and broadening variations of the appended claims.

What is claimed is:

1. A tubular film cutting arrangement for cutting tubular shrink film into sleeves of suitable length for application to containers, the arrangement comprising:

a film path along which film travels;

a plurality of rotatable knife drive pulleys spaced apart around the film path, each knife drive pulley having a knife member mounted for rotation with the knife drive pulley;

a plurality of idlers rotatably arranged to define a drive belt path between the knife drive pulleys and the idlers;

a drive system for the knife drive pulleys, including:

a primary mover assembly spaced away from the knife drive pulleys and the idlers;

a single drive belt that both (i) engages with the primary mover assembly so as to be moved by the primary mover and (ii) extends to and along the drive belt path such that a first side of the drive belt is in contact with each of the knife drive pulleys and a second side of the drive belt is in contact with each of the idler rollers, and the plurality of idlers are positioned to interact with the second side of the drive belt in order to hold the first side of the drive belt in contact with the knife drive pulleys.

2. The tubular film cutting arrangement of claim 1 wherein, both the knife drive pulleys and the idlers are mounted on a plate having an opening through which the film path travels;

the primary mover assembly is spaced apart from the support member and the single drive belt extends from the drive belt path and beyond a perimeter of the support member to the primary mover.

3. The tubular film cutting arrangement of claim 1, wherein the drive belt path includes an entry side and an exit side located proximate each other, the entry side defined between a first of said knife drive pulleys and an entry idler, the exit side defined between a second of said knife drive pulleys and an exit idler, the single drive belt first extends from the prime mover to the entry idler before contacting any knife drive pulley, and extends from the exit idler to the prime mover assembly without any intermediate contact with any knife drive pulley.

4. The tubular film cutting arrangement of claim 1, further comprising:

a tooling mandrel located within the film path such that film is passed around the tooling mandrel as it moves past the knife drive pulleys, wherein the tooling mandrel has a shape that is non-round in cross-section at least in vicinity of the knife drive pulleys to hold film in a non-round cross-sectional configuration during cutting.

5. The tubular film cutting arrangement of claim 1, further comprising:

a tooling mandrel located within the film path such that film is passed around the tooling mandrel as it moves past the knife drive pulleys, wherein the tooling mandrel has a shape that is round in cross-section at least in vicinity of the knife drive pulleys to hold film in a round cross-sectional configuration during cutting.

6. The tubular film cutting arrangement of claim 1 wherein each knife member has opposed cutting edges to enable cutting of film regardless of direction of rotation of the knife member, and a control is provided for the prime mover, wherein the control is configured to alternatingly and repeatedly control the prime mover to move the drive belt in a first direction for one film cutting operation and a second, opposite direction for a next cutting film cutting operation.

* * * * *